US007941063B2

(12) United States Patent
Suzuki et al.

(10) Patent No.: US 7,941,063 B2
(45) Date of Patent: May 10, 2011

(54) IMAGE FORMING APPARATUS WITH LOOP CONTROL

(75) Inventors: Akimichi Suzuki, Yokohama (JP); Hideo Nanataki, Yokohama (JP); Kenji Watanabe, Suntou-gun (JP); Kenji Takagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/355,233

(22) Filed: Jan. 16, 2009

(65) Prior Publication Data

US 2009/0129797 A1 May 21, 2009

Related U.S. Application Data

(63) Continuation of application No. PCT/JP2008/066014, filed on Aug. 29, 2008.

(30) Foreign Application Priority Data

Aug. 29, 2007 (JP) ..... 2007-222570

(51) Int. Cl.
*G03G 15/00* (2006.01)
*G03G 15/20* (2006.01)

(52) U.S. Cl. ..... 399/44; 399/43; 399/68

(58) Field of Classification Search ..... 399/44, 399/68

See application file for complete search history.

(56) References Cited

U.S. PATENT DOCUMENTS 5,940,668 A 8/1999 Tanigawa et al. ..... 399/302
6,477,348 B2 11/2002 Miyamoto et al. ..... 399/299
2007/0264038 A1* 11/2007 Koshida ..... 399/68
2008/0179810 A1 7/2008 Watanabe et al. ..... 270/58.12

(Continued)

FOREIGN PATENT DOCUMENTS

JP 7-234604 9/1995

(Continued)

OTHER PUBLICATIONS

International Preliminary Report on Patentability dated Mar. 2, 2010, in counter International Patent Application No. PCT/JP2008/066014.

*Primary Examiner* — David M Gray
*Assistant Examiner* — Andrew V Do
(74) *Attorney, Agent, or Firm* — Fitzpatrick, Cella, Harper & Scinto

(57) ABSTRACT

An image forming apparatus is provided, which prevents occurrence of conveying malfunction or image failure due to variation of conveying speed caused by endurance of a fixing unit or a conveying unit, variation of using environment, or a type of a recording material. The image forming apparatus includes: a fixing unit for heating and fixing a toner image on a recording sheet (P); a secondary transferring portion for conveying the recording sheet (P) to the fixing unit; a loop sensor for detecting a degree of a loop of the recording sheet (P) generated according to a speed difference between a conveying speed of the fixing unit and a conveying speed of the secondary transferring portion; a CPU for controlling the conveying speed of the fixing unit; a fixing deliver sensor for detecting a used amount of the fixing unit; and an EEPROM for storing information on the used amount of the fixing unit detected by the fixing deliver sensor. The CPU controls the conveying speed of the fixing unit based on the information of the used amount of the fixing unit stored in the EEPROM and a detection result of the loop sensor.

4 Claims, 6 Drawing Sheets

U.S. PATENT DOCUMENTS

| | | | | |
|---|---|---|---|---|
| 2008/0202302 | A1 | 8/2008 | Hayashi et al. | 83/256 |
| 2009/0134563 | A1 | 5/2009 | Watanabe et al. | 270/45 |

FOREIGN PATENT DOCUMENTS

| | | |
|---|---|---|
| JP | 10-340012 | 12/1998 |
| JP | 2001-282072 | 10/2001 |
| JP | 2002-372888 | 12/2002 |
| JP | 2005-203181 | 7/2005 |
| JP | 2005-338562 | 12/2005 |
| JP | 2006-139150 | 6/2006 |
| JP | 2007-58083 | 3/2007 |

* cited by examiner

IMAGE FORMING APPARATUS WITH LOOP CONTROL

This application is a continuation of International Application No. PCT/JP2008/066014 filed on Aug. 29, 2008, which claims the benefit of Japanese Patent Application No. 2007-222570 filed on Aug. 29, 2007.

BACKGROUND OF THE INVENTION

1. Field of the Invention

The present invention relates to an image forming apparatus, in particular, a controlling method used in an image forming apparatus that electrophotographically forms images and fixes the formed image onto a recording material.

2. Description of the Related Art

In a conventional image forming apparatus, a toner image on an image bearing member is transferred onto a recording material by transferring means such as a transferring roller and the recording material is led via a conveyance guide to a nip portion of a fixing portion, which fixes the toner image. However, there may be a state in which a rear end portion of the recording material has not passed through the transferring portion when a leading end portion of the recording material is led to the nip portion of the fixing portion.

In this case, the recording material is conveyed by both the fixing portion and the transferring portion. Therefore, if a recording material conveying speed of the fixing portion is faster than a recording material conveying speed of the transferring portion, the recording material becomes stretched resulting in deterioration of image quality such as a color drift or a transferring shake in a transferring step. In contrast, if the recording material conveying speed of the transferring portion is faster than the recording material conveying speed of the fixing portion, a loop (or curve) becomes too large resulting in lack of space for maintaining an appropriate loop shape. Therefore, there may be a problem that a surface of an unfixed image is rubbed in the apparatus.

Therefore, as described in Japanese Patent Application Laid-Open No. H07-234604, a loop is usually formed in the recording material before an inlet of the fixing portion, and an amount of the loop is adjusted (hereinafter, referred to as "loop control") so as to suppress the deterioration of image quality in the transferring step or a contact of the unfixed image with a structural element of the apparatus between the transferring and fixing stages. Specifically, a sensor is disposed for sensing an upper limit and a lower limit of the amount of the loop formed in the recording material. When the upper limit of the loop amount is sensed, a speed of a drive source (motor) of a drive system for the fixing means is increased by a constant amount. In addition, when the lower limit of the loop amount is sensed, a speed of the drive source of the drive system for the fixing means is decreased by a constant amount.

On the other hand, Japanese Patent Application Laid-Open No. H10-340012 proposes an image forming apparatus including a loop detecting sensor for detecting a loop in a recording material, which is disposed at a conveyance guide portion between the fixing portion and transferring portion. Based on a result of the detection, the recording material conveying speed of the fixing portion or transferring portion is switched so that the loop amount of the recording material becomes a value within a predetermined range.

In addition, Japanese Patent Application Laid-Open No. 2001-282072 proposes an image forming apparatus including two detecting sensors for detecting a loop amount of a recording material conveyed from the transferring portion to a fixing nip portion of the fixing device. If one of the sensors detects a loop amount, the recording material conveying speed is controlled in the direction for decreasing the loop amount. If the other sensor detects a loop amount, the recording material conveying speed is controlled in the direction for increasing the loop amount. Thus, the loop amount of the recording material can be controlled to be a value within a constant range.

However, if the loop control described in each of Japanese Patent Application Laid-Open No. H07-234604, Japanese Patent Application Laid-Open No. H10-340012, and Japanese Patent Application Laid-Open No. 2001-282072 is performed, the following problem may occur.

The loop control described in Japanese Patent Application Laid-Open No. H07-234604 adjusts the loop amount by switching the drive system drive source (motor) of the drive system for the fixing portion between two speeds, one of which is a predetermined high speed (H) and another one of which is a predetermined low speed (L). If the fixing portion is driven at the high speed (H), the loop amount of the recording material is decreased. In contrast, if the fixing portion is driven at the low speed (L), the loop amount of the recording material is increased.

There may be a case where the recording material conveying speed of the fixing portion is different despite the same r.p.m. of the motor. For instance, a recording material conveying roller of the fixing portion may be deteriorated gradually along with an increase of a accumulative used amount of the image forming apparatus, or a surface characteristic of the recording material may be changed due to a variation of environment in which the image forming apparatus is installed. This variation of the recording material conveying speed may occur in the transferring portion, too. Such a variation factor of the recording material conveying speed should be taken into account, and the high speed (H) should be preset to be such a value that the loop amount of the recording material can be sufficiently small. In addition, the low speed (L) should be preset to be such a value that the loop amount of the recording material can be sufficiently large.

Therefore, a speed difference between the high speed (H) and the low speed (L), i.e., a speed control range should be secured widely considering influences of endurance variations of the fixing means and the transferring means, using environment of the image forming apparatus, a type of the recording material and the like.

A fixing unit provided to the image forming apparatus is usually designed to have a life period shorter than that of a main body of the image forming apparatus, and hence the fixing unit is replaced at the end of its life with a new fixing unit. If the fixing unit has a short period of life, it is considered that a difference between the recording material conveying speed when the fixing unit is new and the recording material conveying speed when the fixing unit is close to the end of its life is small. Therefore, a speed difference between the high speed (H) and the low speed (L) of the motor can also be decreased.

However, if the fixing unit has a long period of life, it is considered that a difference between the recording material conveying speed when the fixing unit is new and the recording material conveying speed when the fixing unit is close to the end of its life is large. Therefore, it is necessary to set the speed difference between the high speed (H) and the low speed (L) of the motor to be a large value.

In this case, the loop control may cause hunting. As a result, the loop amount of the recording material is hardly controlled within a desired range, and hence gross unevenness corresponding to the switching of the fixing speed or unevenness of overhead transparency (OHT) may occur. In a worse case, paper wrinkle due to unstable conveying, stretching between the transferring means and the fixing portion, image abrasion due to an increase of the loop, and color drift of each color due to a variation of a load on the recording material may also occur.

SUMMARY OF THE INVENTION

The present invention has been made in view of the above-mentioned points, and it is therefore an object of the present invention to provide an image forming apparatus that can stabilize loop control of a recording material and can prevent occurrence of a trouble in the image forming process regardless of endurance states of fixing means and conveying means, using environment of the image forming apparatus and a type of the recording material.

In order to achieve the above-mentioned object, an image forming apparatus according to the present invention has the following features.

Specifically, the image forming apparatus comprises: an image forming portion for forming a toner image on a recording material; a fixing unit for fixing the toner image formed on the recording material onto the recording material, the fixing unit having a roller for conveying the recording material; a motor for driving the roller; a loop detection portion disposed between the image forming portion and the fixing unit, for detecting a loop of the recording material; a control portion for controlling the motor; a fixing unit used amount detection portion for detecting a used amount of the fixing unit; and a storage portion for storing an accumulative used amount of the fixing unit. The control portion controls an a rotation speed of the motor according to information on the accumulative used amount of the fixing unit stored in the storage portion and an output of the loop detection portion.

According to the present invention, the loop control can be stabilized even in the image forming apparatus using the fixing unit having a long designed life.

Further features of the present invention will become apparent from the following description of exemplary embodiments with reference to the attached drawings.

DESCRIPTION OF THE EMBODIMENTS

Hereinafter, an exemplary embodiment of the present invention will be described in detail with reference to examples.

Example 1

Figure 1:
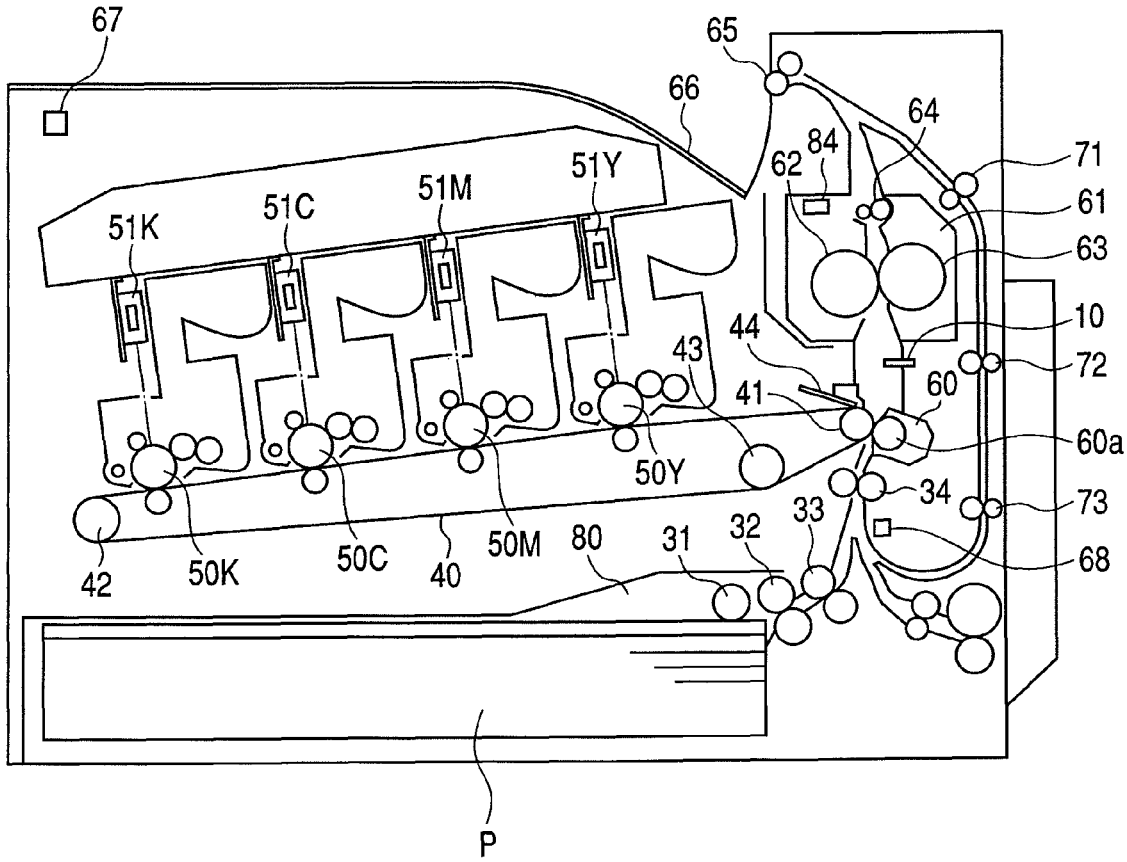
FIG. 1 is a cross section illustrating entire structure of a color image forming apparatus according to Example 1 of the present invention.

Image Forming Apparatus (FIG. 1)

FIG. 1 is a cross section illustrating an entire structure of a color image forming apparatus according to Example 1. This apparatus is a tandem color image forming apparatus adopting an intermediate transferring member, which is an example of an electrophotographic color image forming apparatus.

An image signal is sent to an image data input portion of the color image forming apparatus directly or via a printer controller from a host computer (hereinafter referred to as host PC) connected to a network or from an operation panel. Photosensitive drums 50Y, 50M, 50C and 50K are disposed in image forming stations having color toner (developer) of yellow, magenta, cyan and black, respectively. Each of laser scanner devices 51Y, 51M, 51C and 51K corresponding to the individual colors irradiates a laser beam onto each surface of the photosensitive drums 50Y, 50M, 50C and 50K so as to form a latent image based on image data sent from a control portion of the image forming apparatus. The surfaces of the photosensitive drums 50Y, 50M, 50C and 50K on which the latent images are formed are supplied with toner of yellow, magenta, cyan and black, respectively, and hence toner images are formed. An intermediate transferring belt (intermediate transferring member) 40 is stretched over a drive roller 41, a tension roller 42 and an idler roller 43. The toner images of the individual colors formed on the photosensitive drums 50Y, 50M, 50C and 50K are primarily transferred onto the intermediate transferring belt 40.

In addition, a paper feed cassette 80 contains a stack of recording sheets P as recording materials. The recording sheet P is fed by a sheet feed roller 31 and is conveyed by a feed/retard roller pair 32 and a conveying roller pair 33, and hence as to be conveyed to a registration roller pair 34 that is suspended to drive. A recording material type detecting sensor 68 (recording material type detecting means) for detecting a type of the recording sheet P (recording material type) is disposed at a vicinity of the registration roller pair 34, and hence a type of the recording sheet P can be detected. Skew feeding of the recording sheet P is corrected by the registration roller pair 34, and then the recording sheet P is conveyed to a secondary transferring portion 60 at a predetermined timing so that the toner image on the intermediate transferring belt 40 is transferred. Toner remaining on the intermediate transferring belt 40 after the secondary transferring is removed by a cleaning device 44 (cleaning means).

The recording sheet P is conveyed to a fixing unit 61 by the intermediate transferring belt 40 and a secondary transferring roller 60*a* that also has a role as a recording material conveying means (details will be described later). A loop sensor 10 is disposed between the secondary transferring portion 60 and the fixing unit 61, and hence as to perform rate control for adjusting a loop amount (curve amount) of the recording sheet P caused by a speed difference between the secondary transferring portion 60 and the fixing unit 61 (details will be described later). In the fixing unit 61, the recording sheet P is nipped between a fixing roller 62 and a pressure roller 63 so that the toner image on the recording sheet P is heated and fixed. The fixing unit 61 has an exchangeable unit structure and is equipped with a fuse 84 for detecting whether or not the fixing unit 61 is a new one (fixing unit newness detecting means). The recording sheet P that has passed the fixing unit 61 is conveyed by a fixing delivery roller pair 64 and a delivery roller pair 65, and the recording sheets P are delivered and stacked on a deliver tray 66. When the printer controller instructs a double-sided print job, a conveying direction of the recording sheet P is reversed by the delivery roller pair 65, and the recording sheet P is conveyed via conveying roller pairs 71, 72 and 73 to reach the registration roller pair 34 again that is suspended to drive. In addition, the image forming apparatus according to Example 1 is equipped with an environmental sensor 67 (environment detecting means) so that temperature (environmental temperature) and humidity (environmental humidity) can be detected in the place where the image forming apparatus is used.

Secondary Transferring Portion 60 (Conveying Means)

In the secondary transferring portion 60, the recording sheet P is nipped between the intermediate transferring belt 40 and the secondary transferring roller 60*a* to be conveyed by the same. The intermediate transferring belt 40 has a thickness of 0.1 mm made up of polyimide resin in which carbon is dispersed so that the volume resistivity is adjusted to $10^8$ ohm-cm, and the intermediate transferring belt 40 is driven to rotate by the drive roller 41 as one of looping rollers. The secondary transferring roller 60*a* is made up of a core metal covered with foam rubber having a medium resistance (real resistance of a nip forming portion is within the range of $10^7$ to $10^9$ ohms when 500 volts is applied). Then, the secondary transferring roller 60*a* is driven to rotate by a motor (not shown) disposed in a main body apparatus (main body of image forming apparatus) via a drive gear (not shown) disposed at an end of the core metal. In addition, the secondary transferring roller 60*a* is positioned so as to have a penetration amount of approximately 0.4 mm with respect to the intermediate transferring belt 40.

Figure 2:
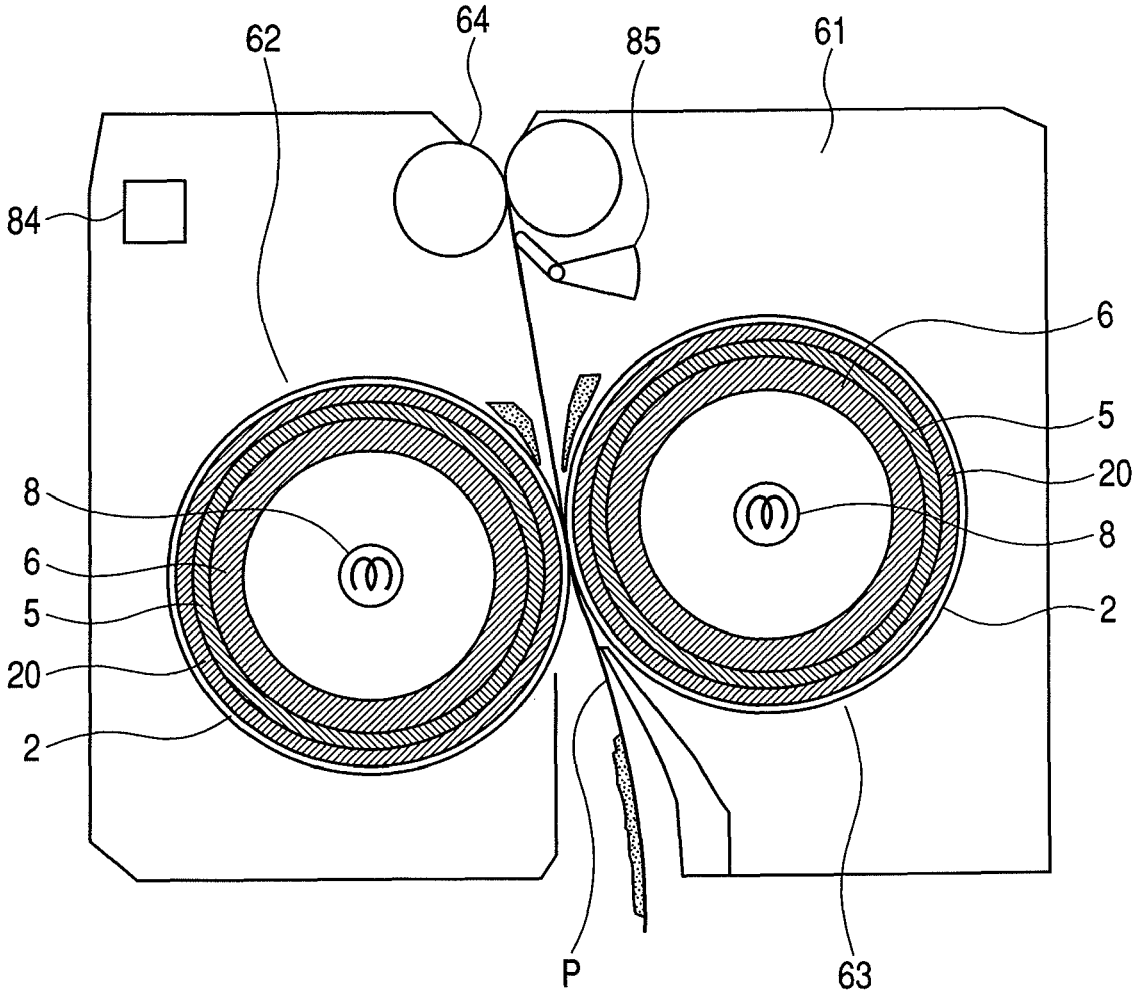
FIG. 2 is a schematic diagram of a side view cut partially of a fixing unit according to Example 1 of the present invention.

Structure of Fixing Unit (FIG. 2)

FIG. 2 is a schematic diagram of a side view cut partially of the fixing unit 61.

The fixing roller 62 and the pressure roller 63 have substantially the same structure in this example. More specifically, they have a three-layered structure, which includes an elastic layer 5 made of silicone rubber, an intermediate layer 20 made of fluororubber latex, and a mold release layer 2 made of a PFA coat formed on a core metal 6 made of aluminum (Al6063). A halogen heater 8 is disposed inside the core metal 6. The silicone rubber of the elastic layer 5 has thermal conductivity of approximately 0.40 W/m-K, test piece hardness of approximately 10 degrees as JIS-A hardness, and a thickness of approximately 1.9 mm for the fixing roller 62 or approximately 2.1 mm for the pressure roller 63. The fluororubber latex of the intermediate layer 20 is made up of fluororubber in which PFA particles are dispersed and has a thickness of approximately 40 to 60 μm. The PFA coat on the mold release layer 2 has a thickness of approximately 20 μm. Each of the fixing roller 62 and the pressure roller 63 has an outer diameter of 45 mm. As for roller hardness, the fixing roller 62 has approximately 67 degrees and the pressure roller 63 has approximately 65 degrees (Asker Type C, 1 kgf load). At a total load of 60 kgf, a nip width of approximately 9 mm has been obtained. An effective roller length is approximately 330 mm. A wide fixing nip width can be obtained with thin rubber thickness, and the pressure at a nip portion is increased to be approximately 2.0 kgf/cm$^2$, for instance, and hence good fixing property is obtained at a fixing temperature of 180 degrees centigrade and a fixing speed of 120 mm per second. In addition, it is possible to obtain an image having an appropriate gloss such that an output image has a gloss of approximately 15 to 40 degrees (a gloss value at 75 degrees measured by using a glossmeter PG-3D manufactured by Nippon Denshoku Industries Co., Ltd.). The rotation drive of the fixing roller 62 is performed via a gear (not shown) disposed at an end of the fixing roller 62, and the pressure roller 63 is driven to idly rotate. A fixing drive portion will be described later in description of loop control.

In addition, the fixing unit 61 is equipped with the fuse 84 for newness detection and a fixing deliver sensor 85 (used amount detecting means of fixing means) that is used for detecting paper jam (paper conveying error) or detecting used amount of the fixing unit 61.

Figure 3:
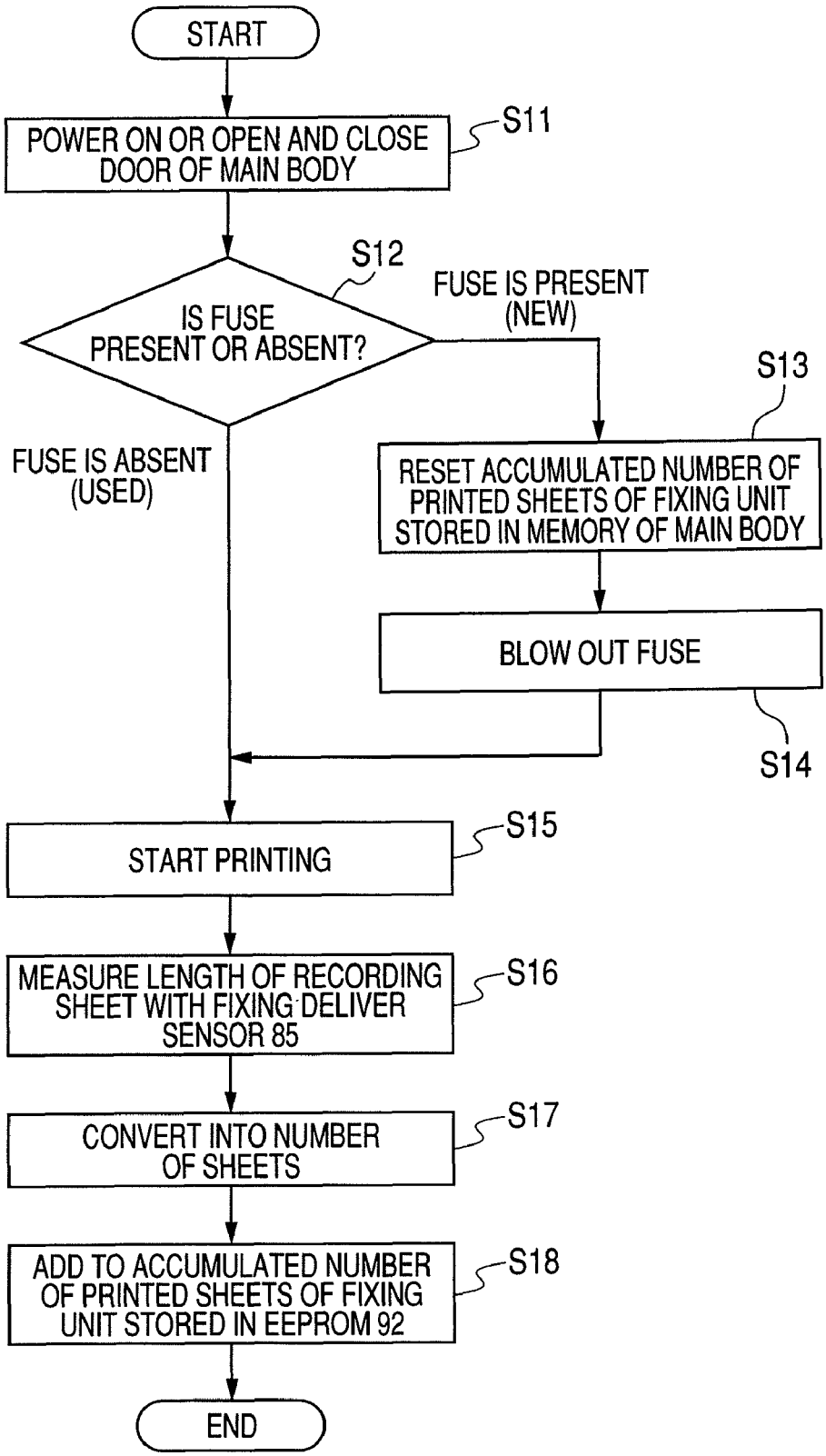
FIG. 3 is a flowchart illustrating a flow of used amount detection control of the fixing unit according to Example 1 of the present invention.
Figure 4:
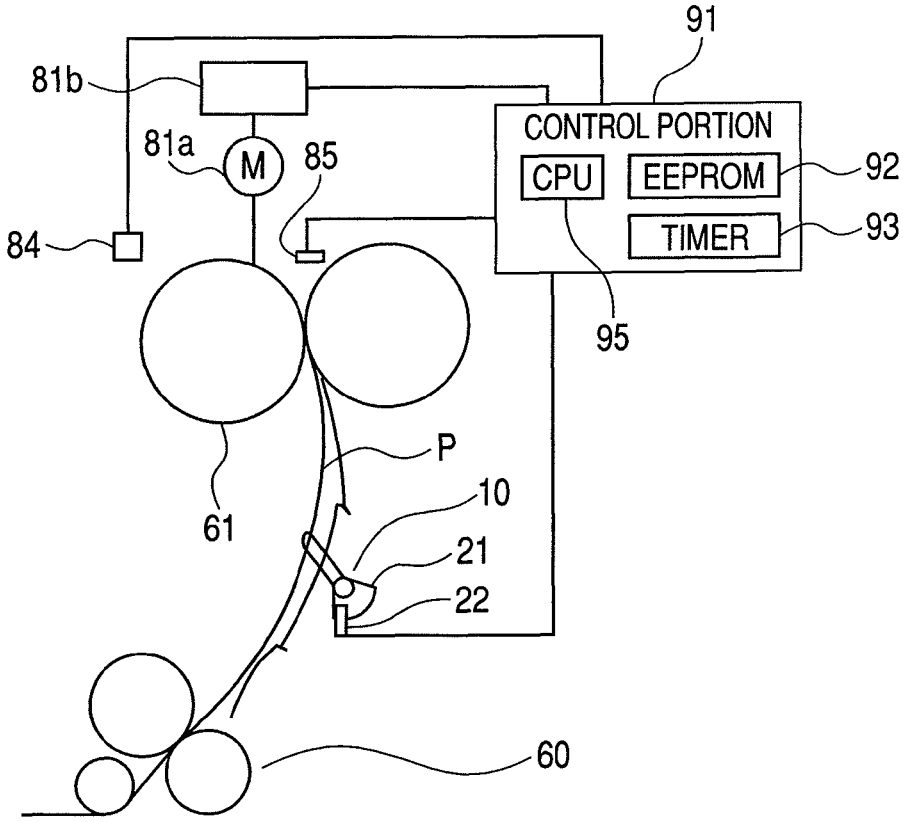
FIG. 4 is a diagram illustrating loop control of the fixing unit according to Example 1 of the present invention.

Detection of Fixing Unit Used Amount (FIGS. 3 and 4)

Detection of the used amount of the fixing unit 61 (i.e., accumulative used amount from new state) is performed by recording material number count of the recording sheets P and newness detection of the fixing unit 61. The newness detection is performed with a discrimination member such as the fuse 84 provided to the fixing unit 61 deciding whether or not it is a new one. More specifically, if the newness detecting means provided to the image forming apparatus main body detects that the fuse 84 is not blown out, it is decided that the fixing unit 61 is a new one. After that, the fuse 84 is blown out so that the fixing unit 61 is not decided to be a new one.

FIG. 3 illustrates a flowchart of used amount detection control of the fixing unit 61. In addition, FIG. 4 illustrating the loop control of the fixing unit 61 is also used in the following description.

After power supply is turned on or a door of the image forming apparatus main body is opened and closed (Step S11, hereinafter "Step" is omitted), it is detected whether or not the fixing unit 61 is a new one based on presence or absence of the fuse 84 of the fixing unit 61 (S12). If the fixing unit 61 is not a new one (in case of "fuse absence" in S12), the apparatus becomes a READY state as usual. In contrast, if the fixing unit 61 is a new one (in case of "fuse presence" in S12), the accumulated number of printed sheets (accumulative used amount) of the fixing unit 61 stored in a non-volatile memory (EEPROM 92) (storage portion) in a control portion 91 of the image forming apparatus main body is reset (S13). After that, the fuse 84 of the fixing unit 61 is blown out based on an instruction from a CPU 95 (S14), and the apparatus becomes the READY state.

When the print job is started based on an instruction from the printer controller (S15), a length of the recording sheet P (recording material length) is measured by the fixing deliver sensor 85 in the fixing unit 61 and a timer 93 of the control portion 91 (S16). The length of the recording sheet P is converted into a number count based on a unit of one sheet of LETTER size width (215.9 mm) (S17). The number count is calculated down to the first decimal place and is added to the accumulated number of printed sheets of the fixing unit 61 stored in the EEPROM 92 (non-volatile memory) of the control portion 91 (S18). In addition, a life of the fixing unit 61 is 100,000 sheets, and it is fixed to 100,000 sheets if the accumulated number of printed sheets exceeds 100,000 sheets. In other words, the control portion 91 manages the accumulative used amount of the fixing unit 61 by converting it into the accumulated number of printed sheets.

Note that the discrimination member for the newness detection may be a memory capable of storing information provided to the fixing unit 61. If the fixing unit 61 is a new one, information of the newness is stored in the memory. Then, when the fixing unit 61 is attached to the image forming apparatus main body (hereinafter, also simply referred to as a main body), information stored in the memory is read via a main body electrical contact provided to the main body. If the information stored in the memory indicates its newness, it is decided that the fixing unit 61 is a new one. After that, the information in the memory is rewritten to be information indicating not a new one. The operation of reading this information in the memory is performed when power supply to the main body is turned on or when a door of the main body is opened and closed.

Loop Control (FIG. 4)

The color image forming apparatus of this example is equipped with the loop sensor 10 (loop detecting means) for detecting the loop amount (curve amount) of the recording sheet P, which is disposed between the fixing unit 61 and the secondary transferring portion 60 (transferring means) as illustrated in FIG. 4.

This loop sensor 10 has a lever member that rotates when the recording sheet abuts the same, and hence as to detect whether or not the loop amount of the recording sheet P reaches a constant value or larger by detecting whether or not a flag 21 at a base of the lever member interrupts light to a detecting sensor 22 made up of a light sensor. The CPU 95 (control means) of the control portion 91 performs the following control so as to adjust the loop amount of the recording sheet P. It controls speed of a fixing motor 81*a* based on a result of a signal detected by the detecting sensor 22 and a speed set value obtained from the accumulated number of printed sheets of the fixing unit 61 stored in the EEPROM 92 of the control portion 91.

The fixing drive portion includes the fixing motor 81*a* and a motor driver 81*b*, and it uses a micro step five phase stepping motor as the fixing motor 81*a*. A drive signal for this fixing motor 81*a* is generated by the motor driver 81*b*, and a clock signal as a base of the drive signal is delivered from the CPU 95 in the control portion 91. If a period of this clock is shortened, the fixing motor 81*a* can be rotated at high speed. If the period of this clock is elongated, the fixing motor 81*a* can be rotated at low speed.

The drive speed of the fixing roller 62 of the fixing portion is controlled by the CPU 95 that is also speed switching means for switching the speed among a plurality of speed set values (motor rotation frequencies). Note that two-step speed switching can be performed in this example, and the two-step speed set values (motor rotation frequencies) include Vh (corresponding to higher motor rotation number) (first conveying speed) and Vl (corresponding to lower motor rotation number) (second conveying speed). If the loop (curve) of the conveyed recording sheet P is small, the recording sheet P does not contact with the lever portion so that the detecting sensor 22 is in a turned-off state. If the loop amount becomes larger than a predetermined value, the recording sheet P contacts with the lever portion. As a result, the flag 21 interrupts light to the detecting sensor 22 so that the detecting sensor 22 is turned on. Therefore, if the detecting sensor 22 is turned off, the speed of the fixing roller 62 is set to Vl so that the conveying speed of the recording sheet P in the fixing portion is set to be a slow speed. If the detecting sensor 22 is turned on, the speed of the fixing roller 62 is set to Vh so that the conveying speed of the recording sheet P in the fixing portion is set to be a fast speed.

Figure 5:
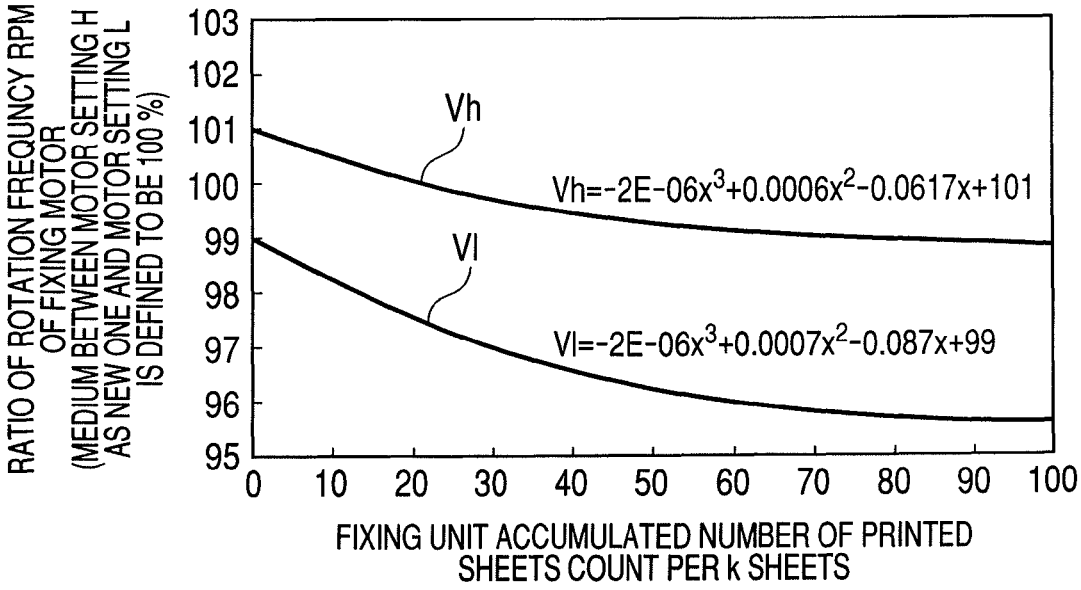
FIG. 5 is a graph plotting values Vh and Vl with respect to the acaccumulated number of printed sheets of the fixing unit according to Example 1 of the present invention.

This example is characterized in that Vh and Vl are variable according to the used amount (accumulated number of printed sheets) of the fixing unit 61. In this embodiment, Vh and Vl are given as functions of the accumulated number of printed sheets x of the fixing unit 61 stored in the memory (EEPROM 92) disposed in the main body as given in Equations (1) and (2) below. In addition, FIG. 5 illustrates a graph in which values of Vh and Vl are plotted corresponding to the accumulated number of printed sheets of the fixing unit 61.

$$Vh=f(x)=-2E-06x^3+0.0006x^2-0.0617x+101 \quad (1)$$

$$Vl=f(x)=-2E-06x^3+0.0007x^2-0.087x+99 \quad (2)$$

Here, as for Vh and Vl, an average of steady rotation frequencies of Vh (higher motor rotation number) and Vl (lower motor rotation number) of the fixing motor 81*a* when the fixing unit is new (0 k sheets) was defined to be 100%, and others were determined as ratios. The accumulated number of printed sheets x of the fixing unit 61 was obtained by dividing the calculated number of sheets by 1000 (k) in the method described above in "(4) Detection of fixing unit used amount".

Figure 6:
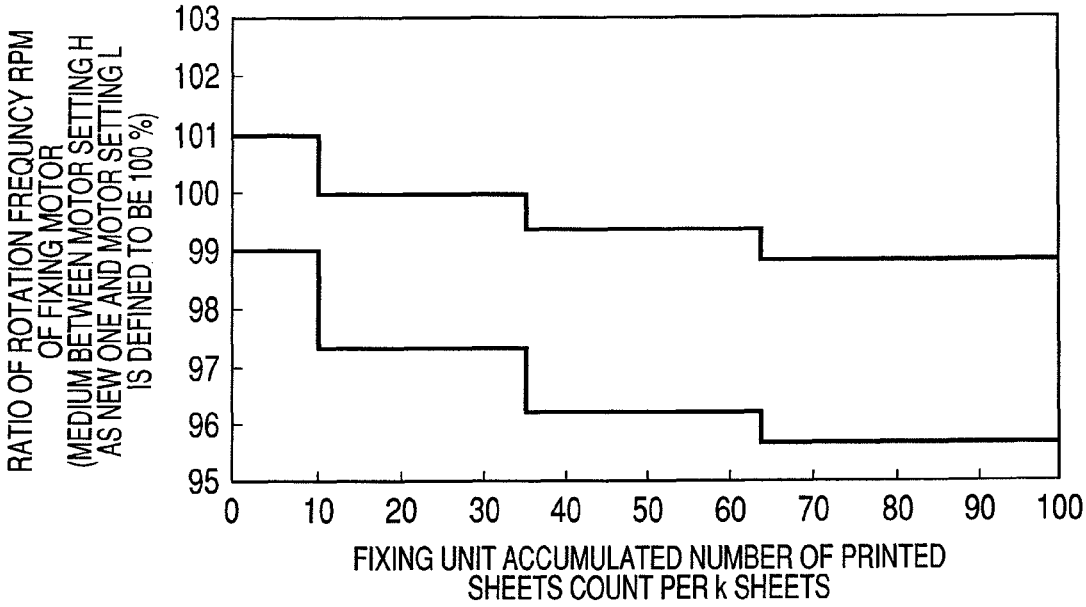
FIG. 6 is a graph plotting the values Vh and Vl with respect to the acaccumulated number of printed sheets of the fixing unit according to Example 1 of the present invention, which illustrates another example different from that of FIG. 5.

Although Vh and Vl were changed in a stepless manner as the functions of the accumulated number of printed sheets x of the fixing unit 61 in the example described above, it is possible to change the same step by step as illustrated in FIG. 6.

Note that Vh-Vl (control range) was increased if the accumulated number of printed sheets of the fixing unit 61, i.e., the accumulative used amount became a large number in this example in consideration of variation of the fixing unit 61 due to endurance history. However, if the variation of a paper speed in the fixing portion due to endurance does not change regardless of various use history such as a type of paper, using environment, using frequency and the like, it is desirable to set the Vh-Vl (control range) to be as small as possible from a viewpoint of stable conveying of the recording sheet P.

(6) Verification Experiment of Variation in Paper Conveying Speed of Fixing Portion Due to Endurance (Increase of Accumulative Used Amount)

As understood from FIGS. 5 and 6, each of Vh and Vl decreases as the accumulated number of printed sheets of the fixing unit 61 increases in this example. This is because that conveying ability of the recording sheet P in the fixing portion is improved along with endurance of the fixing unit 61 in this structure so that the conveying speed is increased together with the endurance (increase of accumulative used amount). In other words, it is necessary to decrease the rotation frequency of the motor along with the endurance so that the improvement of the conveying ability due to the endurance can be cancelled in order to adjust the paper conveying speed in the fixing portion.

Figure 7:
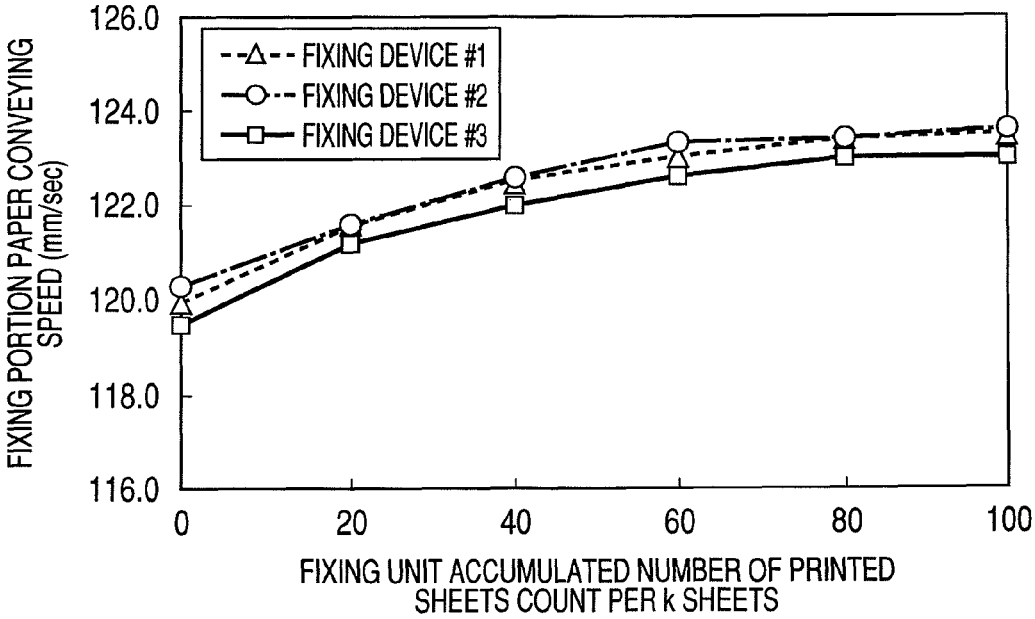
FIG. 7 is a graph illustrating a verification experiment of a variation in paper conveying speed of the fixing portion due to endurance according to Example 1 of the present invention.

FIG. 7 illustrates a result of measurement of the paper conveying speed of the fixing portion performed by inventors of the present invention along with the endurance of fixing when the rotation frequency of the fixing motor 81*a* is constant. The paper speed measurement was performed by measuring a passing time of a toner image formed on a paper sheet using a high speed camera (FASTCAM-1024PCI manufactured by PHOTRON LTD.). After that, an image length of a part used for the measurement of the passing time was measured for calculation. Note that the experiment was performed by using three fixing units (fixing device #1, fixing device #2 and fixing device #3).

As illustrated in FIG. 7, the paper speed of the fixing portion becomes fast according to progress of endurance of the fixing unit 61. As the cause of becoming fast, it is considered that the pressure roller 63 or the recording sheet P slides with the fixing roller 62 so that the surface property of the fixing roller 62 is deteriorated, or that minute unevenness is generated on the surface of the fixing roller 62.

(7) Comparison Experiment, Comparison Between Conventional Method and this Example A result of comparison experiment between the loop control of this example and the loop control of the conventional method, using the image forming apparatus of this example, will be described below.

Setting of Vh and Vl in Conventional Method

In the loop control of the conventional method, the speed set values of Vh and Vl are constant values throughout the endurance of the fixing unit 61. Therefore, it is necessary to decide the values Vh and Vl taking an influence of the variation of the paper conveying speed due to the endurance of the fixing unit 61 into account in advance. In other words, Vl must be decided so that the loop amount of the fixing portion is increased in the loop control even in the case where the paper conveying speed of the fixing unit 61 becomes faster due to the endurance. Vh must be set so that the loop amount of the fixing portion is decreased in the loop control in the case where a new fixing unit 61 is used. In the structure of this example, it is necessary to set Vh=101% and Vl=95.6% as given in the above-mentioned Equations (1) and (2) or illustrated in FIG. 3. The control range (Vh-Vl) becomes 5.4%.

On the other hand, as for setting of Vh and Vl in the present invention, Vh and Vl associated with the accumulated number of printed sheets of the fixing unit 61 are selected as described in "(5) Loop control".

The comparison experiment was performed by using a new fixing unit and a fixing unit that had endured 100,000 sheets. The test method included printing 1,000 sheets, and performing overall evaluation of levels about the numbers of paper wrinkles and image abrasions, that were considered to be caused by hunting of the loop control, and image evaluation, and evaluation by three grades A, B and C was performed. A is defined to be the case where no paper wrinkle or no image abrasion has occurred. B is defined to be the case where a minute level of the paper wrinkle or the image abrasion has occurred. C is defined to be the case where frequency or a level of occurrence of the paper wrinkle or the image abrasion is relatively high. In addition, speed set values Vh and Vl of the fixing motor 81*a* and the control range (Vh-Vl) are also indicated in the table.

TABLE 1

| | | Fixing unit endurance | | | | | |
|---|---|---|---|---|---|---|---|
| | Item | New fixing unit | | | Fixing unit that has endured 100,000 sheets | | |
| Loop control of the conventional technique | Vh Vl Vh-Vl | 101.0 | 95.6 | 5.4 | 101.0 | 95.6 | 5.4 |
| | Paper wrinkle | | B | | | A | |
| | Image abrasion | | A | | | C | |
| Loop control of the present invention | Vh Vl Vh-Vl | 101.0 | 99.0 | 2.0 | 98.8 | 95.6 | 3.2 |
| | Paper wrinkle | | A | | | A | |
| | Image abrasion | | A | | | A | |

As understood from a result illustrated in Table 1, when the loop control of the conventional technique has been performed, paper wrinkle occurred in the new fixing unit (illustrated in table with underline), the cause of which was considered to be that the fixing loop was too large. In addition, an image abrasion occurred in the fixing unit after the endurance (illustrated in table with underline), the cause of which was considered to be that the fixing unit had been stretched. On the other hand, when the loop control of the present invention had been used, stable paper conveying was realized from a new fixing unit to a fixing unit after the endurance. The paper wrinkle and the image abrasion were levels that would be accepted in the market.

In addition, it is understood that the conventional loop control has the control range (Vh-Vl) larger than that of this example so that hunting of control is apt to occur. In addition, if the loop sensor 10 cannot detect a posture of the recording sheet P correctly due to a phenomenon such as disturbance of the recording sheet P between the secondary transferring portion 60 and the fixing portion, an extremely large loop may occur and affect the image heavily. On the other hand, it is understood that in the loop control of this example, the control range is small throughout the endurance so that the hunting of control hardly occurs. In addition, even if the loop sensor 10 cannot detect a posture of the recording sheet P correctly due to a phenomenon such as disturbance of the recording sheet P between the secondary transferring portion 60 and the fixing portion, the control range is small so that stable paper conveying can be performed.

As described above, according to this example, a control value of the loop control is determined according to the used amount (accumulated number of printed sheets) of the fixing unit 61, and hence stable paper conveying can be performed throughout the endurance of the fixing unit 61. Then, good images can be formed without paper wrinkle, image abrasion or other image failure due to disturbance of paper conveying.

Example 2

In this example, a fixing rate control is changed based on the used amount (accumulative used amount) information of the fixing unit (fixing means) and used amount (accumulated number of printed sheets) information of a transferring unit that also works as the conveying means.

A structure of the apparatus and a fixing rate control step in this example are the same as those described in Example 1, and hence detailed descriptions thereof will be omitted while the same reference numerals are used. Only the differences will be described.

(8) Used Amount Detection of Transferring Unit

Used amount detection of the transferring unit, which is made up of a fuse (not shown) (transferring unit newness detecting means) for newness detection for detecting that a transferring unit including the secondary transferring roller 60*a* and the secondary transferring portion 60 is a new, is performed similarly to the used amount detection of the fixing unit 61. In other words, it is performed as the recording material number count of the recording sheets P and the newness detection of the transferring unit.

A flow of the used amount detection control of the transferring unit is the same as in "(4) Detection of fixing unit used amount" described in Example 1 except for measuring the length of the recording sheet P by the registration roller pair 34 (used amount detecting means of conveying means), and hence description thereof will be omitted. In addition, a life of the transferring unit is 150,000 sheets. If the accumulated number of printed sheets exceeds 150,000 sheets, it is fixed to 150,000 sheets.

(9) Fixing Unit Rate Control Step

This example is characterized in that Vh and Vl are variable according to the used amounts (accumulated number of printed sheets) of the transferring unit and the fixing unit 61. In this embodiment, as given in Equations (3) and (4) below, Vh and Vl are given as functions of the accumulated number of printed sheets x of the fixing unit 61 and the accumulated number of printed sheets y of the transferring unit stored in the memory (EEPROM 92) (storing means) in the main body.

$$Vh=f(x,y)=-2E-06x^3+0.0006x^2-0.0617x-0.01y+101 \quad (3)$$

$$Vl=f(x,y)=-2E-06x^3+0.0007x^2-0.087x-0.01y+99 \quad (4)$$

Here, as for Vh and Vl, an average of Vh (higher motor rotation number) and Vl (lower motor rotation number) when the apparatus had been shipped, i.e., the fixing unit 61 and the transferring unit had been new was defined to be 100%, and others were determined as ratios. The accumulated number of printed sheets x of the fixing unit 61 and the accumulated number of printed sheets y of the transferring unit were obtained by dividing the number of sheets obtained by the above-mentioned method by 1,000.

In this example, the paper speed of the secondary transferring portion 60 becomes slow according to the used amount of the transferring unit. Therefore, the rotation frequency of the fixing roller 62 is corrected to be decreased according to increase of the used amount of the secondary transferring roller 60*a*. The paper speed of the secondary transferring portion 60 becomes slow according to the endurance (increase of used amount) mainly because that an outer diameter of the secondary transferring roller 60*a* for conveying paper sheets becomes small along with the endurance.

In this example, the speed Vh and the speed Vl of the motor 81*a* for the fixing unit that are used for the loop control are changed based on used amount information of the transferring unit and the fixing unit 61, respectively. However, if a speed variation in the endurance of the transferring unit is predominant, it is effective to change the speed Vh and the speed Vl of the motor for fixing based on only the used amount information of the transferring unit.

As described above, according to this example, since the control value of the loop control is determined according to the used amounts (accumulated number of printed sheets) of the transferring unit and the fixing unit 61, stable paper conveying can be performed throughout the endurance of the apparatus. Then, it is possible to form good images without paper wrinkle, image abrasion or other image failure due to disturbance of paper conveying.

Example 3

This example is the same as Example 1 except for changing the speed Vh and the speed Vl of the motor 81*a* for the fixing unit 61 that are used for the loop control according to a result of detection by the environmental sensor 67 (environment detecting means) disposed in the apparatus main body. Therefore, the same reference numerals are used, and only the difference will be described.

(10) Fixing Unit Rate Control Step Based on Environmental Sensor Result

In this example, similarly to Example 1, it is controlled so that Vh (higher motor rotation number) and Vl (lower motor rotation number) are switched based on a detection result of the loop sensor 10. In this embodiment, as given in Equations (5) and (6) below, Vh and Vl are decided based on the accumulated number of printed sheets x of the fixing unit 61 stored in the memory in the main body and a temperature result t (degrees centigrade) of the environmental sensor 67.

$$Vh=f(x,t)=-2E-06x^3+0.0006x^2-0.0617x+(t-23\times0.03+101 \quad (5)$$

$$Vl=f(x,t)=-2E-06x^3+0.0007x^2-0.087x+(t-23)\times0.03+99 \quad (6)$$

Here, as for Vh and Vl, an average of Vh (higher motor rotation number) and Vl (lower motor rotation number) when the apparatus had been shipped, i.e., the fixing unit 61 and the transferring unit had been new was defined to be 100%, and others were determined as ratios. The accumulated number of printed sheets x of the fixing unit 61 was obtained by dividing the number of sheets obtained by the above-mentioned method by 1,000.

This is because that temperature environment in the apparatus causes a variation of the outer diameter of the secondary transferring roller 60*a* that also works as the paper conveying means so that relative paper conveying speed between the fixing portion and the secondary transferring portion 60 will change. Therefore, the speed Vh and the speed Vl are corrected according to the detection result of the environmental sensor 67 so as to perform correction control for realizing more stable paper conveying.

As described above, according to this example, the control value of the loop control is determined according to the used amount (accumulated number of printed sheets) of the fixing unit 61 and the using environment (using temperature), and hence stable paper conveying can be performed regardless of the using environment and the endurance state of the apparatus. Then, it is possible to form good images without paper wrinkle, image abrasion or other image failure due to disturbance of paper conveying.

Example 4

This example is the same as Example 1 except for changing of the speed Vh and the speed Vl of the motor 81*a* for the fixing unit 61 that are used for the loop control according to a detection result of the recording material type detecting sensor 68 (recording material type detecting means) disposed in the apparatus main body, and hence only the difference will be described.

(11) Recording Material Type Detecting Sensor

Figure 8:
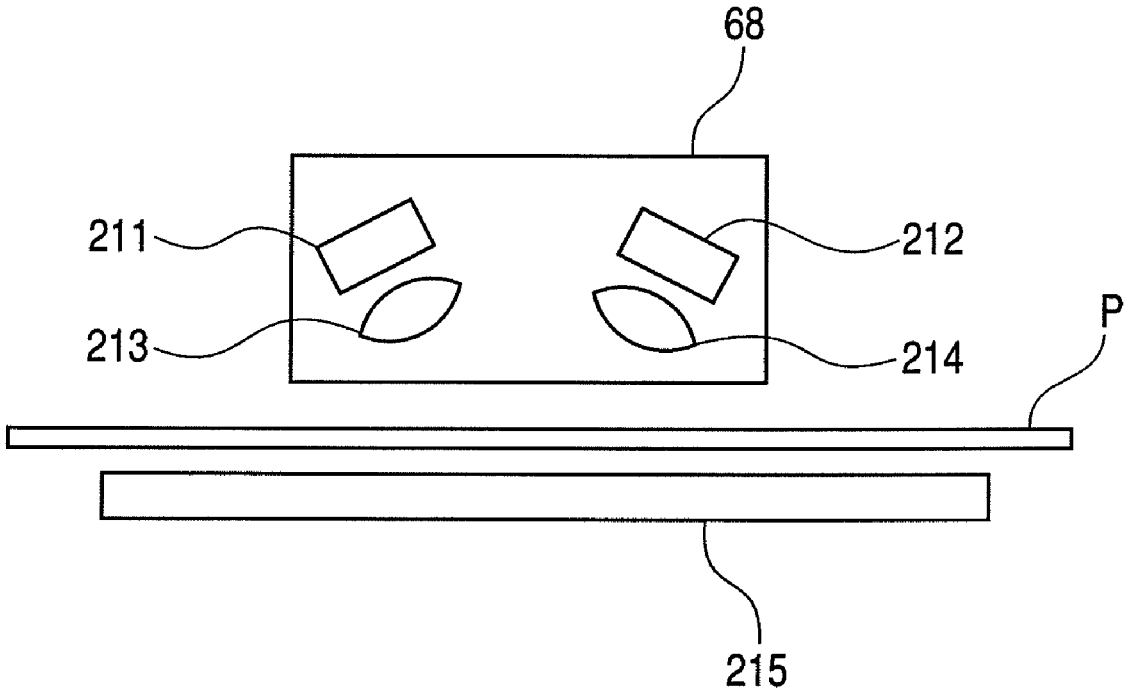
FIG. 8 is a schematic diagram of a recording material type detecting sensor according to Example 4 of the present invention.

The recording material type detecting sensor 68 will be described with reference to FIG. 8. The recording material type detecting sensor 68 includes an LED 211 for projecting light onto the surface of the recording sheet P and a complementary metal oxide semiconductor (CMOS) area sensor 212 for sensing and outputting a light irradiated region on the surface of the recording material irradiated with light from the LED 211 as an image. The recording material type detecting sensor 68 also includes an LED lens 213, a CMOS area sensor lens 214 and a recording material conveyance guide 215. Light emitted from the LED 211 passes through the LED lens 213 and is projected onto the recording sheet P in a slanting direction, which moves along the recording material conveyance guide 215. Reflection light from the recording sheet P passes through the CMOS area sensor lens 214 to be condensed onto the CMOS area sensor 212 as an image of the surface of the recording sheet P to be read. Since the light emitted from the LED 211 is projected onto the recording sheet P in the slanting direction, shadows are generated according to unevenness of the surface of the recording sheet P. Therefore, it is possible to detect glossiness and transparency of the recording sheet P from an average light amount of the image read by the CMOS area sensor 212. In addition, it is possible to detect the depth of the unevenness of the surface of the recording sheet P from a difference between a maximum value and minimum value of contrast of the image read by the CMOS area sensor 212. In addition, it is possible to detect an interval of the unevenness of the surface of the recording sheet P from the number of edges in a binarized image of the image read by the CMOS area sensor 212. Detection of the glossiness and transparency of the recording sheet P as well as the depth (depth of unevenness) and the interval (interval of unevenness) of the unevenness of the surface of the recording sheet P enables detection of a type of the recording material such as plain paper, rough paper, coated paper, OHT, a resin film according to classification illustrated in Table 2.

TABLE 2

| Type of recording material | Glossiness | Transparency | Depth of unevenness | Interval of unevenness |
|---|---|---|---|---|
| Plain paper | Low | Low | Medium | Medium |
| Rough paper | Low | Low | High | Short |
| Coated paper | Medium | Low | Low | Medium |
| OHT | High | High | Low | Long |
| Resin film | High | Low | Low | Long |

(12) Fixing Unit Rate Control Step Based on Result of Recording Material Type Detecting Sensor This example also performs the control of switching Vh (higher motor rotation number) and Vl (lower motor rotation number) based on a detection result of the loop sensor 10 similarly to Example 1. In this embodiment, the speed Vh and the speed Vl are set as given in Equations (7-1) to (7-3) and (8-1) to (8-3) below. In other words, Vh and Vl are determined based on the accumulated number of printed sheets x of the fixing unit stored in the memory (EEPROM 92) in the main body and a result of the recording material type detecting sensor 68.

$$Vh=f(x)=-2E-06x^3+0.0006x^2-0.0617x+101+0 \text{(if plain paper)} \quad \text{Equation (7-1)}$$

$$Vh=f(x)=-2E-06x^3+0.0006x^2-0.0617x+101+0.2 \text{(if rough paper)} \quad \text{Equation (7-2)}$$

$$Vh=f(x)=-2E-06x^3+0.0006x^2-0.0617x+101-0.1 \text{(if coated paper, OHT, or resin film)} \quad \text{Equation (7-3)}$$

$$Vl=f(x)=-2E-06x^3+0.0007x^2-0.087x+99+0 \text{(if plain paper)} \quad \text{Equation (8-1)}$$

$$Vl=f(x)=-2E-06x^3+0.0007x^2-0.087x+99+0.2 \text{(if rough paper)} \quad \text{Equation (8-2)}$$

$$Vl=f(x)=-2E-06x^3+0.0007x^2-0.087x+99-0.1 \text{(if coated paper, OHT, or resin film)} \quad \text{Equation (8-3)}$$

Here, as for Vh and Vl, an average of Vh (higher motor rotation number) and Vl (lower motor rotation number) when the apparatus is shipped from the factory, i.e., when the fixing unit 61 is new, is defined to be 100%, and others are determined as ratios. The accumulated number of printed sheets x of the fixing unit 61 and the number of sheets obtained by the above-mentioned method are divided by 1,000.

This is because a conveying force of the secondary transferring roller 60*a* changes depending on a type of the recording material, and hence the paper conveying speed changes resulting in a change of a relative paper conveying speed between the fixing portion and the secondary transferring portion 60. Then, a result of the recording material type detecting sensor 68 is fed back to the rate control of the fixing portion for correction, and hence the paper conveying can be stabilized.

INDUSTRIAL APPLICABILITY

As described above, according to this example, the control value for the loop control is determined according to the used amount (accumulated number of printed sheets) of the fixing unit 61 and a result of the recording material type detecting sensor 68. Therefore, stable paper conveying can be performed regardless of a type of the recording material and the endurance state. Then, it is possible to form good images without image failure due to paper wrinkle, image abrasion or other disturbance of paper conveying.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-222570, filed Aug. 29, 2007, which is hereby incorporated by reference herein in its entirety.

What is claimed is:

1. An image forming apparatus, comprising:

an image forming portion that forms a toner image on a recording material;

a fixing unit that fixes the toner image formed on the recording material onto the recording material, said fixing unit having a roller for conveying the recording material;

a motor that drives the roller;

a loop detection portion disposed between the image forming portion and the fixing unit, said loop detection portion detecting a loop of the recording material;

a control portion that controls said motor, the control portion selects a rotation speed Vh of said motor for decreasing the loop of the recording material or a rotation speed Vl of said motor for increasing the loop of the recording material in accordance with an output of the loop detection portion so that a loop amount of the recording material falls in a predetermined range;

a fixing unit used amount detection portion for detecting a used amount of the fixing unit; and a storage portion that stores an accumulative-used amount of the fixing unit, wherein the control portion sets the speed Vh and the speed Vl in accordance with information of the accumulative-used amount of the fixing unit, and the larger the accumulative-used amount of the fixing unit is, the greater a difference (Vh−Vl) between the speed Vh and the speed Vl becomes.

2. An image forming apparatus according to claim 1, further comprising:

a photosensitive member that bears the toner image; and a transferring unit that transfers the toner image from the photosensitive member to the recording material, wherein said control portion sets the each of the speed Vh or the speed Vl according to the information on the accumulative-used amount of the fixing unit and information on a accumulative-used amount of the transferring unit.

3. An image forming apparatus according to claim 1, further comprising an environmental sensor that senses temperature in environment in which the image forming apparatus is installed, wherein said control portion sets the each of the speed Vh or the speed Vl according to the information on the accumulative-used amount of the fixing unit and the temperature sensed by the environmental sensor.

4. An image forming apparatus according to claim 1, further comprising a recording material type detecting sensor for detecting a type of the recording material, wherein the control portion sets the each of the speed Vh or the speed Vl according to the information on the accumulative-used amount of the fixing unit and a detection result of the recording material type detecting sensor.

* * * * *